US007284380B2

(12) United States Patent
Brasseur

(10) Patent No.: US 7,284,380 B2
(45) Date of Patent: Oct. 23, 2007

(54) METHOD FOR HEAT ENERGY TRANSMISSION

(75) Inventor: Olivier Brasseur, Ratingen (DE)

(73) Assignee: Gea Ecoflex GmbH (DE)

( * ) Notice: Subject to any disclaimer, the term of this patent is extended or adjusted under 35 U.S.C. 154(b) by 218 days.

(21) Appl. No.: 11/146,510

(22) Filed: Jun. 7, 2005

(65) Prior Publication Data

US 2006/0201166 A1 Sep. 14, 2006

(30) Foreign Application Priority Data

Mar. 9, 2005 (EP) ..... 05005089

(51) Int. Cl.
*F25D 17/06* (2006.01)
*F25D 17/02* (2006.01)
*F28F 3/08* (2006.01)

(52) U.S. Cl. ..... 62/93; 62/434; 165/167

(58) Field of Classification Search ..... 62/92, 62/93, 197, 272, 406, 434, 430–432; 165/167
See application file for complete search history.

(56) References Cited

U.S. PATENT DOCUMENTS 3,282,334 A * 11/1966 Stahlheber ..... 165/166
3,946,804 A * 3/1976 Tkach et al. ..... 165/167
4,216,002 A * 8/1980 Rosenblad ..... 203/87
4,480,591 A 11/1984 Deckers
4,969,507 A * 11/1990 Rosenblad ..... 165/115
6,360,557 B1 * 3/2002 Reznik ..... 62/402
6,470,835 B1 10/2002 Stansfield et al.
6,568,466 B2 * 5/2003 Lowenstein et al. ..... 165/153
6,745,826 B2 * 6/2004 Lowenstein et al. ..... 165/115
7,134,483 B2 * 11/2006 Barnwell ..... 165/11.1
2005/0067137 A1 * 3/2005 Barnwell ..... 165/11.1
2005/0211421 A1 * 9/2005 Ekelund et al. ..... 165/114

FOREIGN PATENT DOCUMENTS

DE 43 07 608 9/1994
EP 0 658 735 6/1995
EP 1 475 579 11/2004
FR 2 814 538 3/2002
SU 1273140 A1 * 11/1986

* cited by examiner

*Primary Examiner*—Mohammad M. Ali
(74) *Attorney, Agent, or Firm*—Cantor Colburn LLP

(57) ABSTRACT

The invention relates to a method for heat energy transmission between a gaseous, warmer medium on one hand and a liquid, colder medium on the other hand. In order to provide an improved method for heat energy transmission, the invention suggests a method in which the liquid and the gaseous media are passed by each other using a plate heat exchanger, wherein the gaseous medium is cooled down and the water contained therein is condensed out, while the heat energy released due to condensation is transferred to the liquid medium.

6 Claims, 1 Drawing Sheet

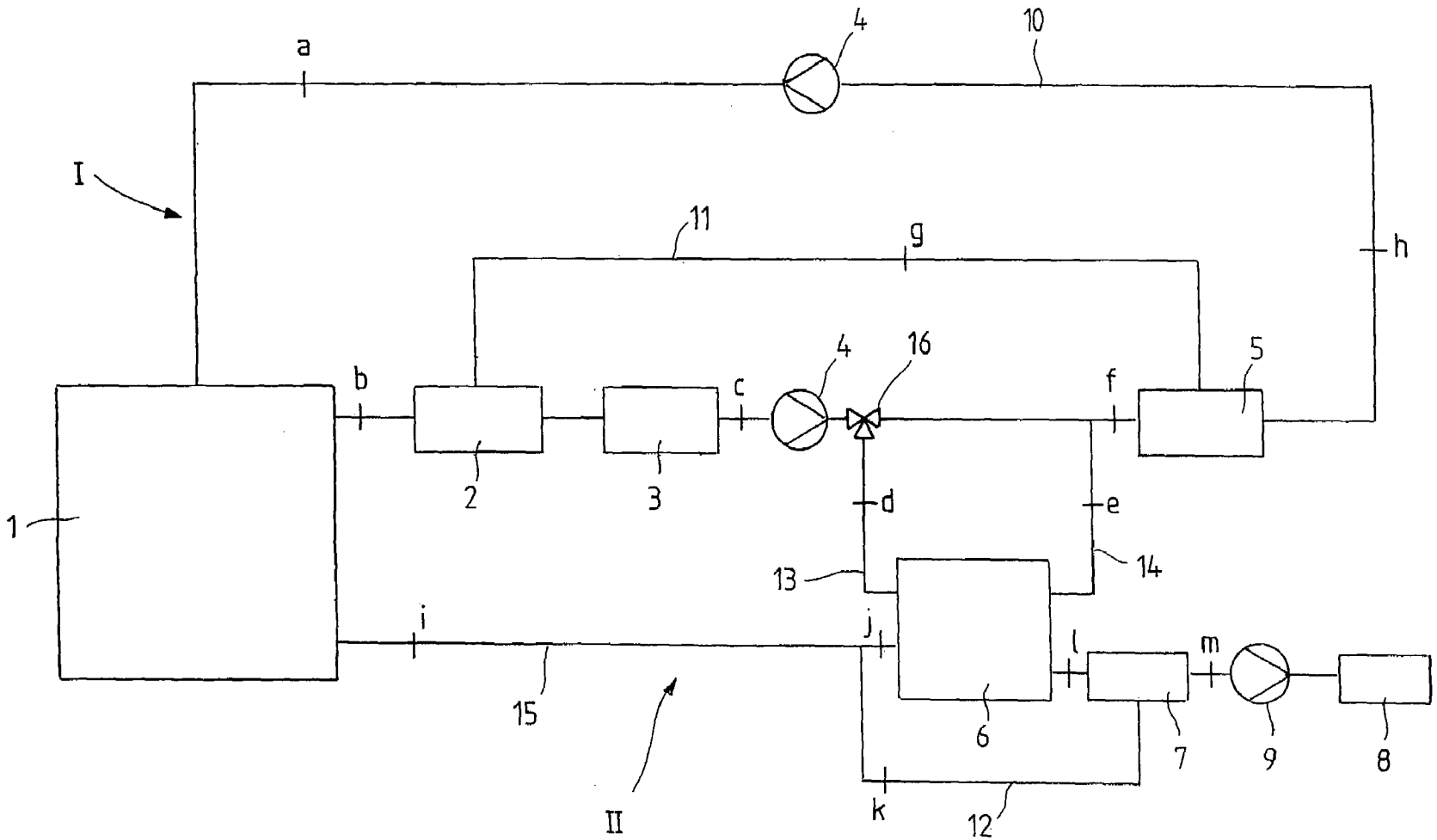
1
2
3
4
4
5
6
7
8
9
10
11
12
13
14
15
16
a
b
c
d
e
f
g
h
i
j
k
l
m
I
II

METHOD FOR HEAT ENERGY TRANSMISSION

TECHNICAL FIELD OF INVENTION

The invention relates to a method for heat energy transmission between a gaseous, warmer medium on the one hand and a liquid, colder medium on the other hand.

BRIEF DESCRIPTION OF RELATED ART

Methods of this kind are known from the state of the art as such, so that the published prior art does not need to be mentioned separately here. It is also known from the state of the art that plate heat exchangers are used for heat energy transmission. Plate heat exchangers are well-known as such from the prior art, for example from EP 0 658 735 B1.

Although methods for heat energy transmission are known from the state of the art and have proven useful in practical applications, they are not free from disadvantages. Therefore, the constant endeavor exists to optimize methods of the afore-mentioned kind, especially with respect to their efficiency.

The invention provides a method for heat energy transmission between a gaseous, warmer medium on the one hand and a liquid, colder medium on the other hand, in which the liquid and the gaseous media are passed by each other using a plate heat exchanger, wherein the gaseous medium is cooled down and the water contained therein is condensed out, while the heat energy released due to condensation is transferred to the liquid medium.

Different than in the methods known from the prior art, with the inventive method not only is simple heat transmission between the gaseous medium and the liquid medium accomplished, but, rather, it is provided that the gaseous medium is cooled down so much that the water contained therein is condensed out. The energy released hereby is transferred by means of the plate heat exchange to the liquid medium, which thus heats up. The efficiency of this method is much higher than that of methods known from the state of the art.

The quantity ratio of liquid to gaseous media is selected as a function of the temperature difference between the liquid and gaseous media at the beginning of the heat energy transmission process. For this purpose, the flow of the liquid medium can be split, wherein then only the one part of the liquid medium flow is guided through the plate heat exchanger. As a function of the quantity of liquid medium, the quantity of the liquid medium in the partial current can be determined, with the temperature difference between the liquid and gaseous media at the beginning of the heat transmission process being an important factor. This design advantageously makes it possible to intervene in a regulating manner in the inventive method, so that the execution of the method can be modified in terms of optimized heat energy transmission and can be optionally adjusted.

Pursuant to another feature of the invention, it is provided that the flow of the gaseous medium is divided into a main gas current, on one hand, and a secondary gas current, on the other hand, before reaching the plate heat exchanger. The main gas current is guided through the plate heat exchanger for the purpose of heat energy transmission, while the secondary gas current is guided around the plate heat exchanger. The secondary gas current in this respect represents a bypass for the plate heat exchanger.

The point and purpose of the secondary gas current, i.e., of the bypass, is to mix the main gas current after passing through the plate heat exchanger again with the secondary gas current, so that a drop below the acid dew point can be prevented. For this purpose, the quantity ratio of main gas current to secondary gas current should be selected appropriately. To mix the main gas current and the secondary gas current, a mixer is preferably used, which is arranged downstream from the plate heat exchanger in the direction of flow.

Pursuant to another feature of the invention, it is provided to employ a hybrid heat exchanger as the plate heat exchanger, which has proven especially suitable for achieving optimized heat energy transmission between gaseous media on one hand and liquid media on the other hand.

BRIEF DESCRIPTION OF THE DRAWINGS

Further benefits and features of the invention result from the following description on the basis of the only FIGURE It shows in a diagrammatic illustration the sequence of the inventive method.

DETAILED DESCRIPTION OF THE INVENTION

As the FIGURE shows, the liquid medium is guided in a closed flow circuit I for the purpose of generating electric energy. Said flow circuit I is here represented by a pipe 10, in which the liquid medium, for example feed water, is circulated by means of pumps 4.

The liquid medium is guided in a boiler 1, where it is evaporated. The resulting vapor is then guided through a turbine 2 for the purpose of creating electric energy. After passing through the turbine 2, the vapor reaches a condenser 3, where the liquid medium is condensed out. The resulting condensate is re-circulated into the boiler 1 via a degasser 5. In this way, as the FIG. clearly shows, the turbine 2 and the degasser 5 are connected from a fluidic point of view via a bypass 11.

The exhaust gases that leave the boiler 1 are fed to the chimney 8 as a gaseous medium via the opening flow circuit II. For this purpose, a suction gas exhaust 9 is arranged in the pipe 15.

Pursuant to the invention, at least a portion of the liquid medium, which leaves the condenser 3, is discharged via the feed 13 and the discharge 14 through a plate heat exchanger 6, which is preferably designed as a hybrid heat exchanger. For this purpose, the feed 13 is connected to the pipe 10, with a freely adjustable valve 16 being interposed. In the plate heat exchanger 6, the liquid medium is conducted past a portion of the gaseous medium leaving the boiler 1 as exhaust gas. This leads to a cooling of the gaseous medium, wherein the water contained therein is condensed out. Heat energy released due to the condensation is transferred to the liquid medium, so that the liquid medium leaving the plate heat exchanger 6 is warmer than the liquid medium entering the plate heat exchanger 6.

Before entering the plate heat exchanger 6, the flow of the gaseous medium is divided into a main gas flow and a secondary gas flow. The main gas flow is guided through the plate heat exchanger 6, while the secondary gas flow is guided around the plate heat exchanger 6 as a bypass 12. A mixer 7, in which the main gas flow leaving the plate heat exchanger 6 is mixed with the secondary gas flow guided past the plate heat exchanger 6, is arranged behind the plate heat exchanger 6 in the direction of flow. The quantity ratio of the main gas flow to the secondary gas flow is selected such that a drop below the acid dew point is prevented.

As the FIGURE shows, the entire flow of the liquid medium is not guided through the plate heat exchanger 6. Rather, via the feed 13 and the discharge 14, only a portion of the liquid medium passes through the plate heat exchanger 6. The quantity ratio of liquid medium to gaseous medium, which are guided through the plate heat exchanger 6, is selected as a function of the temperature difference between the liquid and gaseous media at the beginning of the heat energy transmission process. In this way, the execution of the method can be optimized as a function of the media temperatures, to ensure that optimal heat energy transmission always occurs to the liquid medium with respect to the available media quantities and the prevailing temperature differences.

To further clarify the inventive method, measuring areas a-m have been marked in the diagrammatic illustration in the FIG, wherein the reading at these measuring areas are reflected in the following table:

| Measuring Area | Temperature | Pressure | Enthalpy |
|---|---|---|---|
| a | 109° C. | 60 bar | 461 kJ/kg |
| b | 300° C. | 60 bar | 2,885 kJ/kg |
| c | 30° C. | 1.4 bar | 126 kJ/kg |
| d | 30° C. | 2 bar | 126 kJ/kg |
| e | 100° C. | 1.4 bar | 418 kJ/kg |
| f | 79° C. | 1.4 bar | 330 kJ/kg |
| g | 180° C. | 3 bar | 2,824 kJ/kg |
| h | 109° C. | 1.4 bar | 457 kJ/kg |
| i | 199° C. | | 218.9 kJ/kg |
| j | 199° C. | | 229 kJ/kg |
| k | 199° C. | | 218.9 kJ/kg |
| l | 50° C. | | 54 kJ/kg |
| m | 95° C. | | 102 kJ/kg |

Using the values reflected by way of example in the above table, a heat recovery of 2,559 kW is achieved when employing the method pursuant to the invention.

The invention claimed is:

1. Method for heat energy transmission between a gaseous, warmer medium on one hand and a liquid, colder medium on another hand, the method comprising:

passing the liquid and the gaseous media by each other using a plate heat exchanger, wherein the gaseous medium is cooled down and water contained therein is condensed out, and transferring the heat energy released due to condensation to the liquid medium, wherein a quantity ratio of the liquid to the gaseous medium is selected as a function of the temperature difference between the liquid and gaseous media at the beginning of the transferring of the heat energy.

2. Method pursuant to claim 1, wherein a flow of the gaseous medium is divided into a main flow and a secondary flow before reaching the plate heat exchanger.

3. Method pursuant to claim 2, wherein the secondary flow of the gaseous medium is guided around the plate heat exchanger.

4. Method pursuant to claim 2, wherein the main flow of the gaseous medium, after passing the plate heat exchanger, is mixed with the secondary gas flow of the gaseous medium guided past the plate heat exchanger.

5. Method pursuant to claim 2, wherein a quantity ratio of the main gas flow to the secondary gas flow is selected such that a drop below the acid dew point is prevented.

6. Method pursuant to claim 1, wherein a hybrid heat exchanger is the plate heat exchanger.

* * * * *